US010450641B2

(12) United States Patent
Matras et al.

(10) Patent No.: US 10,450,641 B2
(45) Date of Patent: Oct. 22, 2019

(54) DENSIFIED SUPERCONDUCTOR MATERIALS AND METHODS

(71) Applicant: Florida State University Research Foundation, Inc., Tallahassee, FL (US)

(72) Inventors: Maxime R. Matras, Tallahassee, FL (US); Eric Hellstrom, Tallahassee, FL (US); Ulf Trociewitz, Crawfordsville, FL (US); Jianyi Jiang, Tallahassee, FL (US); David Larbalestier, Tallahassee, FL (US)

(73) Assignee: Florida State University Research Foundation, Inc., Tallahassee, FL (US)

( * ) Notice: Subject to any disclaimer, the term of this patent is extended or adjusted under 35 U.S.C. 154(b) by 0 days.

(21) Appl. No.: 15/221,042

(22) Filed: Jul. 27, 2016

(65) Prior Publication Data

US 2017/0032870 A1 Feb. 2, 2017

Related U.S. Application Data

(60) Provisional application No. 62/197,608, filed on Jul. 28, 2015.

(51) Int. Cl.
*C22F 1/14* (2006.01)

(52) U.S. Cl.
CPC ..... *C22F 1/14* (2013.01)

(58) Field of Classification Search
CPC ..... H01B 12/04; C22F 1/14
See application file for complete search history.

(56) References Cited

U.S. PATENT DOCUMENTS

| | | | | |
|---|---|---|---|---|
| 4,774,140 | A * | 9/1988 | Wakasa | C04B 35/524 264/29.6 |
| 5,344,815 | A * | 9/1994 | Su | H01L 39/248 264/211 |
| 5,635,456 | A * | 6/1997 | Riley, Jr. | H01L 39/2464 264/175 |
| 6,555,503 | B1 | 4/2003 | Li et al. | |
| 6,632,776 | B2 | 10/2003 | Kobayashi et al. | |
| 6,694,600 | B2 | 2/2004 | Li et al. | |
| 2003/0036482 | A1 * | 2/2003 | Thieme | H01L 39/141 505/100 |
| 2009/0042731 | A1 * | 2/2009 | Kobayashi | H01L 39/248 505/433 |

FOREIGN PATENT DOCUMENTS

| | | | | |
|---|---|---|---|---|
| WO | WO 96/39366 | * | 12/1996 | C04B 35/45 |
| WO | 01/22436 | A1 | 3/2001 | |

* cited by examiner

*Primary Examiner* — Paul A Wartalowicz
(74) *Attorney, Agent, or Firm* — Eversheds Sutherland (US) LLP

(57) ABSTRACT

Methods of pre-densifying a metal wire containing superconductor materials are provided. Superconductor materials containing the pre-densified wires also are provided. The wires may be pre-densified by subjecting a metal wire that includes one or more filament cavities in which a superconductor precursor powder is disposed to a temperature and a first pressure for a time sufficient to densify the superconductor precursor powder to form a pre-densified metal wire, wherein the temperature is less than the melting point of the superconductor precursor powder, and the first pressure is sufficient, at the temperature, to compress at least a portion of the metal wire.

19 Claims, 3 Drawing Sheets

DENSIFIED SUPERCONDUCTOR MATERIALS AND METHODS

CROSS-REFERENCE TO RELATED APPLICATIONS

This application claims priority to U.S. Provisional Patent Application No. 62/197,608, filed Jul. 28, 2015, which is incorporated herein by reference.

GOVERNMENT LICENSE RIGHTS

This invention was made with government support under contract nos. NSF/DMR-1157490, DE-SC0010421, and R21GM111302 awarded by the National Science Foundation, the Department of Energy, and the National Institute of Health, respectively. The government has certain rights in the invention.

FIELD OF THE INVENTION

This disclosure relates to the treatment of wires containing superconductor precursor powders.

BACKGROUND

It is known that wire containing superconductor powders can be formed using powder-in-tube (PIT) technology. After the wires are drawn, they must be heat treated to melt the superconductor powder, which, upon cooling, can form superconductor crystals. The superconductor crystals can form continuous superconductor filaments in the wire.

A typical wire has one or more cavities for accommodating the superconductor powders, but each cavity can only accommodate an amount of superconductor powder equal to about ⅔ of the volume of each cavity. As a result, the heat treatment needed to melt the superconductor powders usually results in gas-filled internal voids within the filaments, the presence of contaminants, such as carbon and $H_2O$, or a combination thereof.

The gas-filled internal voids commonly agglomerate into large, filament cavity-sized, gas-filled bubbles that can block current transport and/or lead to wire expansion and cracks during the heat treatment that melts the superconductor powders. Such effects are explained in the relevant literature (e.g., Kamentani, F. et al. Supercond. Sci. Technol., vol. 24, no. 7, p. 075009, July 2011; and Malagoli, A. et al. Supercond. Sci. Technol., vol. 26, no. 5, p. 055018, May 2013). As a result, the final processed wire typically has low critical current density, likely due to the small connected current paths within each filament.

Efforts to overcome one or more of these difficulties has resulted in a technique commonly referred to as overpressure (OP) processing (see, e.g., Larbalestier, D. C. et al. Nat. Mater., Vol. 13, No. 4, pp. 375-381, April 2014; U.S. Pat. No. 6,555,503; and WO 2001/022436). In typical OP processes, a wire, usually a coiled wire, is heat treated under sufficient isostatic pressure to compress the wire, thereby decreasing the filament porosity. The filament porosity may be decreased significantly, and, in some instances, to nearly zero in certain OP processes. As a result, the OP process can eliminate large bubbles, increase the mechanical and physical connectivity, and increase the critical current density.

However, the OP processes also reduce the diameter of the wire, typically up to about 5%. Due at least to the reduction in diameter, the coil packing density also can be reduced, which may cause relative movement of the turns of the coil, sagging, other displacements, or a combination thereof that may negatively affect the field quality. It has been discovered that OP processing can cause the top plane of a long coil to sag by about 5% after OP processing. Due to the changes that can be imparted to coils of wire, OP processing typically results in a loose winding pack that can undermine the predictability of coil geometry and coil uniformity. These changes also can be difficult, if not impossible, to correct, due at least to the brittle nature of certain superconductor wires.

Several technologies have been developed in an attempt to reduce the reduction in wire diameter that occurs during OP processing. These technologies include cold isostatic pressing (CIP), swaging, and rolling, which are performed at room temperature.

The CIP technology consists of using isostatic pressure at room temperature to compress a metal wire. Despite relatively high and commercially unfeasible pressures, however, the reduction in diameter that occurs during CIP is not significant enough to offset the foregoing problems caused by OP processing. Swaging involves mechanically hammering a metal wire between circular jaws to decrease its diameter (see Jiang et al. IEEE Trans. Appl. Supercond. 23, 3, 2013, 64002006-6400206). This process typically deforms the wire's internal architecture and can damage the cavities within the wires. Rolling involves the mechanical deformation of the conductor between two rolls. This process typically partially compresses the conductor by deforming a round wire into a tape, which is not the geometry usually preferred when building coils (see Miao, H. et al. Phys. C Supercond. 301, 1-2, 1998, 116-122; U.S. Pat. Nos. 6,694,600; and 6,632,776). Round rolling processes, like cassette rolling, can be similar to swaging. None of these processes, however, sufficiently address the disadvantages associated with diameter reduction that occurs during OP processing.

Therefore, methods that overcome one or more of the foregoing difficulties associated with powder cavity capacity and/or OP processing are desirable.

SUMMARY

Provided herein are methods of pre-densifying a metal wire containing superconductor materials. In embodiments, the methods comprise providing a metal wire comprising one or more filament cavities in which a superconductor precursor powder is disposed; subjecting the metal wire to a temperature and a first pressure for a time sufficient to densify the superconductor precursor powder to form a pre-densified metal wire, wherein the temperature is less than the melting point of the superconductor precursor powder, and the first pressure is sufficient, at the temperature, to compress the metal wire.

In embodiments, the methods further comprise subjecting the pre-densified metal wire to a second pressure and a temperature greater than the melting point of the superconductor precursor powder for a time sufficient to melt the superconductor precursor powder, wherein, upon cooling, the melted superconductor precursor powder forms substantially continuous superconductor filaments.

Also provided herein are superconductor materials, such as superconductor magnets, comprising the pre-densified metal wires.

DETAILED DESCRIPTION

Figure 1:
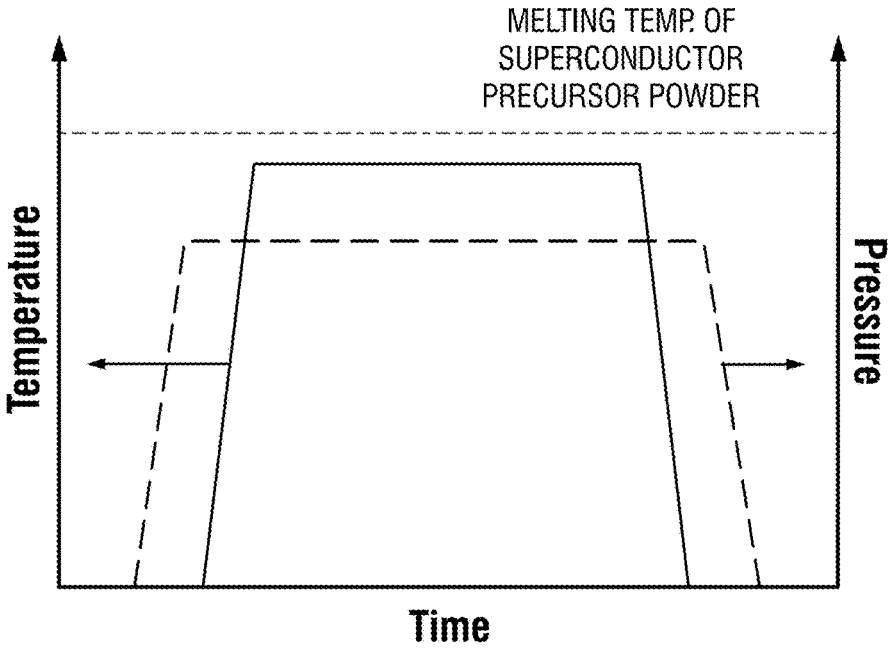
FIG. 1 depicts one embodiment of a temperature and pressure treatment schedule of a pre-densification process.

Provided herein are methods that address one or more of the foregoing difficulties by pre-densifying a wire containing a superconductor precursor powder before the wire is coiled and/or subjected to a heat treatment step that melts the superconductor precursor powder. By pre-densifying the wire according to the methods provided herein, the decrease in wire diameter that may occur during an OP process that melts the superconductor precursor powder can be reduced or eliminated. Reducing or eliminating the decrease in wire diameter that occurs during OP processing that melts the superconductor precursor powder can minimize or eliminate changes to the geometry of a coil or other wire configuration when a pre-densified wire is coiled or placed into another configuration prior to the OP process.

In embodiments, the methods provided herein include pre-densifying a wire by heating it to a temperature that is less than the melting point of the one or more superconductor precursor powders in the wire. In some embodiments, the methods provided herein include pre-densifying a wire by heating it to a temperature that is [1] less than the melting point of the one or more superconductor precursor powders in the wire, but [2] sufficient to soften the material from which the wire is made, such as a metal, e.g., silver or a silver alloy. The temperature, in embodiments, is from about 0.1% to about 50% less than the melting point of the superconductor precursor powder. The temperature, in further embodiments, is from about 0.1% to about 40% less than the melting point of the superconductor precursor powder. The temperature, in additional embodiments, is from about 0.1% to about 30% less than the melting point of the superconductor precursor powder. The temperature, in some embodiments, is from about 5% to about 30% less than the melting point of the superconductor precursor powder. The temperature, in particular embodiments, is from about 10% to about 30% less than the melting point of the superconductor precursor powder. For example, if the melting point of a superconductor precursor powder is 500 K, and the temperature is 10% less than the melting point, then the temperature is 450 K. In an embodiment, the temperature is from about 750 to about 883° C. In one embodiment, the temperature is from about 800 to about 883° C. In a certain embodiment, the temperature is from about 800 to about 880° C. In a particular embodiment, the temperature is from about 820 to about 880° C. In a further embodiment, the temperature is from about 840 to about 880° C. In an additional embodiment, the temperature is from about 850 to about 880° C.

In embodiments, the methods provided herein include pre-densifying a wire by heating it to a temperature that is less than the melting point of the one or more superconductor precursor powders in the wire, and, while subjecting the wire to this temperature, subjecting the wire to a pressure that is greater than ambient pressure. The pressure may be sufficient to compress the wire. In embodiments, a wire is compressed when the cross-sectional diameter of at least a portion of the wire is decreased. The pressure may be an isostatic pressure. Not wishing to be bound by any particular theory, it is believed that an isostatic pressure may avoid or lessen the deformation of round wires. In one embodiment, the pressure is from about 5 atm to about 200 atm. In another embodiment, the pressure is from about 5 atm to about 150 atm. In a particular embodiment, the pressure is from about 50 atm to about 150 atm. In a certain embodiment, the pressure is from about 75 atm to about 150 atm. In a further embodiment, the pressure is from about 75 atm to about 125 atm. In yet another embodiment, the pressure is from about 90 atm to about 110 atm. In a still further embodiment, the pressure is about 100 atm. Persons of skill in the art will understand that in particular embodiments the selection of a relatively high pressure may be required when a relatively high temperature is selected, because it is believed that relatively high temperatures may increase the pressure in the filament cavities, thereby increasing the pressure needed to compress the wire.

Generally, the pressure may be applied by one or more gases. When two or more gases are used to apply the pressure, the partial pressure of oxygen may be adjusted in view of the potential oxidation of the metal wire. For example, the metal wire may be a silver alloy wire, which may be susceptible to oxidation. If oxidation occurs, then the metal wire's stiffness may be altered. Potential difficulties caused by this phenomenon may be eliminated or reduced by adjusting the partial pressure of oxygen. In embodiments, the partial pressure of oxygen is from about 0.1 atm to about 5 atm. In further embodiments, the partial pressure of oxygen is from about 0.2 atm to about 5 atm. In other embodiments, the partial pressure of oxygen is from about 2 atm to about 5 atm.

The pressure and temperature may be applied to the wire for a time sufficient to form a pre-densified wire. As used herein, the phrase "pre-densified wire" refers to a wire that has been subjected to [1] a temperature less than the melting point of the superconductor precursor powder in the wire and [2] a pressure for a time sufficient to compress at least a portion of the wire. In one embodiment, the time of the pre-densification is from about 1 minute to about 6 hours. In a further embodiment, the time of the pre-densification is from about 10 minutes to about 6 hours. In another embodiment, the time of the pre-densification is from about 30 minutes to about 6 hours. In still another embodiment, the time of the pre-densification is from about 1 hour to about 6 hours. In yet another embodiment, the time of the pre-densification is from about 2 hours to about 6 hours. Generally, less time may be required if the temperature and/or pressure is relatively high, and, alternatively, more time may be required if the temperature and/or pressure is relatively low. The foregoing times relate to the duration of the pre-densification process, which may include applying the temperature and pressure for different times and at different times in any order or sequence. For example, a particular embodiment of the pre-densification process may require 10 minutes, and, in such a process, the pressure may be applied at minute 0, the temperature applied at minute 2, the temperature reduced or returned to ambient temperature at minute 8, and the pressure removed at minute 10. For example, a particular embodiment of the pre-densification process may require 10 minutes, and, in such a process, the temperature may be applied at minute 0, the pressure applied at minute 2, the pressure removed or reduced at minute 8, and the temperature reduced or returned to ambient temperature at minute 10.

FIG. 1 depicts a schematic of the application of temperature and pressure during one embodiment of a pre-densification process. In this embodiment, the pressure is applied before the temperature is increased, and the temperature is decreased before the pressure is reduced or removed.

Generally, a wire of any configuration or length may be pre-densified according to the methods provided herein. In embodiments, the wire that is subjected to a pre-densifying process is uncoiled. A wire, however, may be collected on a spool or other apparatus prior to pre-densification.

Generally, a wire may be pre-densified according to the methods provided herein, and then arranged in a different configuration, such as a coil, loop, etc. For example, an uncoiled wire may be pre-densified, and then coiled. The coil may be formed by standard coil winding procedures that are well-known in the art. Other configurations are possible and other techniques may be used, because the pre-densified wires provided herein can be handled, bent, insulated, spooled, wound, etc. Therefore, in embodiments, pre-densified wires provided herein can be used instead of the currently available as-drawn powder-in-tube (PIT) wire when building a coil or other configuration.

After a wire is pre-densified, and, if desired, arranged in a desired configuration, the pre-densified wire then may be subjected to a pressure and a temperature that is above the melting point of the superconductor powder. In one embodiment, this step includes standard OP processing that is well-known in the art. The OP process, in a particular embodiment, is a high isostatic pressure heat treatment. In one embodiment, the OP process is performed at a temperature of about 885° C. to about 950° C., and a pressure of about 50 atm to about 100 atm. In another embodiment, the OP process is performed at a temperature of about 888° to about 892° C., and a pressure of about 50 atm to about 100 atm. In a particular embodiment, the OP process is performed at a temperature of about 890° C., and a pressure of about 50 atm to about 100 atm. In embodiments, these processes melt the superconductor precursor powder, and, upon cooling, the melted superconductor precursor powder forms superconductor filaments that may be at least substantially free of gas-filled internal voids. Therefore, the superconductor filaments may have high-connectivity and high transport current properties.

Figure 2:
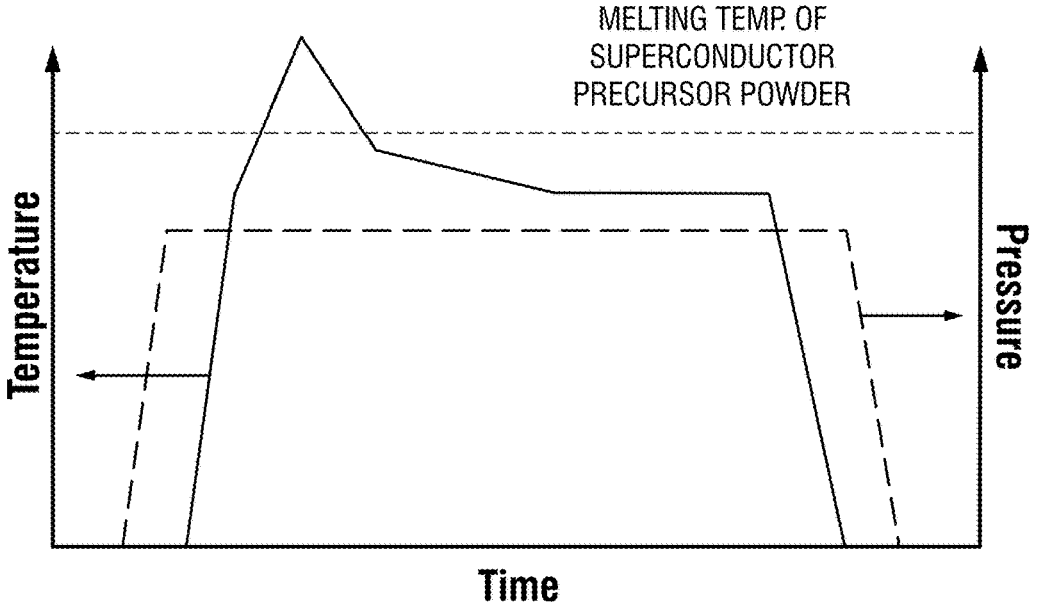
FIG. 2 depicts one embodiment of a temperature and pressure treatment schedule of an OP process during which a superconductor precursor powder is melted.

FIG. 2 depicts one embodiment of the temperature and pressure treatment schedule for an OP process that melts the superconductor precursor powder. In the embodiment depicted at FIG. 2, the pressure is administered before the temperature is increased, and the temperature is decreased before the pressure is reduced or removed. The opposite configuration and other configurations are possible, as long as the superconductor precursor powder is melted during the process.

In embodiments, the pre-densification processes provided herein cause a reduction in the diameter of the wires, thereby lessening the diameter reduction that occurs during heat treatment processes that melt the superconductor precursor powder. Typically, a heat treatment process, such as an OP process, that melts a superconductor precursor powder can reduce the diameter of an un-pre-densified wire by up to 5% or more. This percentage, in particular embodiments, is reduced when the wire is pre-densified according to the methods provided herein before the wire is subjected to a heat treatment process, such as an OP process, that melts the superconductor precursor powder. As a result, a configuration, such as a coil, that has been formed by pre-densified wires may be subjected to a heat treatment process that melts the superconductor precursor powder without substantially altering the configuration. The phrase "without substantially altering" refers to situations in which one or more dimensions of the configuration is changed by 3% or less.

In embodiments, the diameter of at least a portion of a metal wire is reduced by about 1 to about 6% by the pre-densification process. In further embodiments, the diameter of at least a portion of a metal wire is reduced by about 1 to about 5% by the pre-densification process. In still further embodiments, the diameter of at least a portion of a metal wire is reduced by about 2 to about 5% by the pre-densification process. In additional embodiments, the diameter of at least a portion of a metal wire is reduced by about 3 to about 4% by the pre-densification process.

In embodiments, the diameter of at least a portion of a pre-densified metal wire is reduced by about 0.1 to about 2% by a heat treatment that melts the superconductor precursor powder. In further embodiments, the diameter of at least a portion of a pre-densified metal wire is reduced by about 0.3 to about 1.3% by a heat treatment that melts the superconductor precursor powder. In still further embodiments, the diameter of at least a portion of a pre-densified metal wire is reduced by about 0.7 to about 1.2% by a heat treatment that melts the superconductor precursor powder.

In embodiments, the diameter of at least a portion of a metal wire is reduced by about 1 to about 6% by the pre-densification process, and is reduced further by about 0.1 to about 2% by a heat treatment that melts the superconductor precursor powder. In further embodiments, the diameter of at least a portion of a metal wire is reduced by about 1 to about 6% by the pre-densification process, and is reduced further by about 0.3 to about 1.3% by a heat treatment that melts the superconductor precursor powder. In additional embodiments, the diameter of at least a portion of a metal wire is reduced by about 1 to about 6% by the pre-densification process, and is reduced further by about 0.7 to about 1.2% by a heat treatment that melts the superconductor precursor powder.

In embodiments, the diameter of at least a portion of a metal wire is reduced by about 1 to about 5% by the pre-densification process, and is reduced further by about 0.1 to about 2% by a heat treatment that melts the superconductor precursor powder. In further embodiments, the diameter of at least a portion of a metal wire is reduced by about 1 to about 5% by the pre-densification process, and is reduced further by about 0.3 to about 1.3% by a heat treatment that melts the superconductor precursor powder. In additional embodiments, the diameter of at least a portion of a metal wire is reduced by about 1 to about 5% by the pre-densification process, and is reduced further by about 0.7 to about 1.2% by a heat treatment that melts the superconductor precursor powder.

In embodiments, the diameter of at least a portion of a metal wire is reduced by about 2 to about 5% by the pre-densification process, and is reduced further by about 0.1 to about 2% by a heat treatment that melts the superconductor precursor powder. In further embodiments, the diameter of at least a portion of a metal wire is reduced by about 2 to about 5% by the pre-densification process, and is reduced further by about 0.3 to about 1.3% by a heat treatment that melts the superconductor precursor powder. In additional embodiments, the diameter of at least a portion of a metal wire is reduced by about 2 to about 5% by the pre-densification process, and is reduced further by about 0.7 to about 1.2% by a heat treatment that melts the superconductor precursor powder.

In embodiments, the diameter of at least a portion of a metal wire is reduced by about 3 to about 4% by the pre-densification process, and is reduced further by about 0.1 to about 2% by a heat treatment that melts the superconductor precursor powder. In further embodiments, the diameter of at least a portion of a metal wire is reduced by about 3 to about 4% by the pre-densification process, and is reduced further by about 0.3 to about 1.3% by a heat treatment that melts the superconductor precursor powder. In additional embodiments, the diameter of at least a portion of a metal wire is reduced by about 3 to about 4% by the pre-densification process, and is reduced further by about 0.7 to about 1.2% by a heat treatment that melts the superconductor precursor powder.

Figure 3:
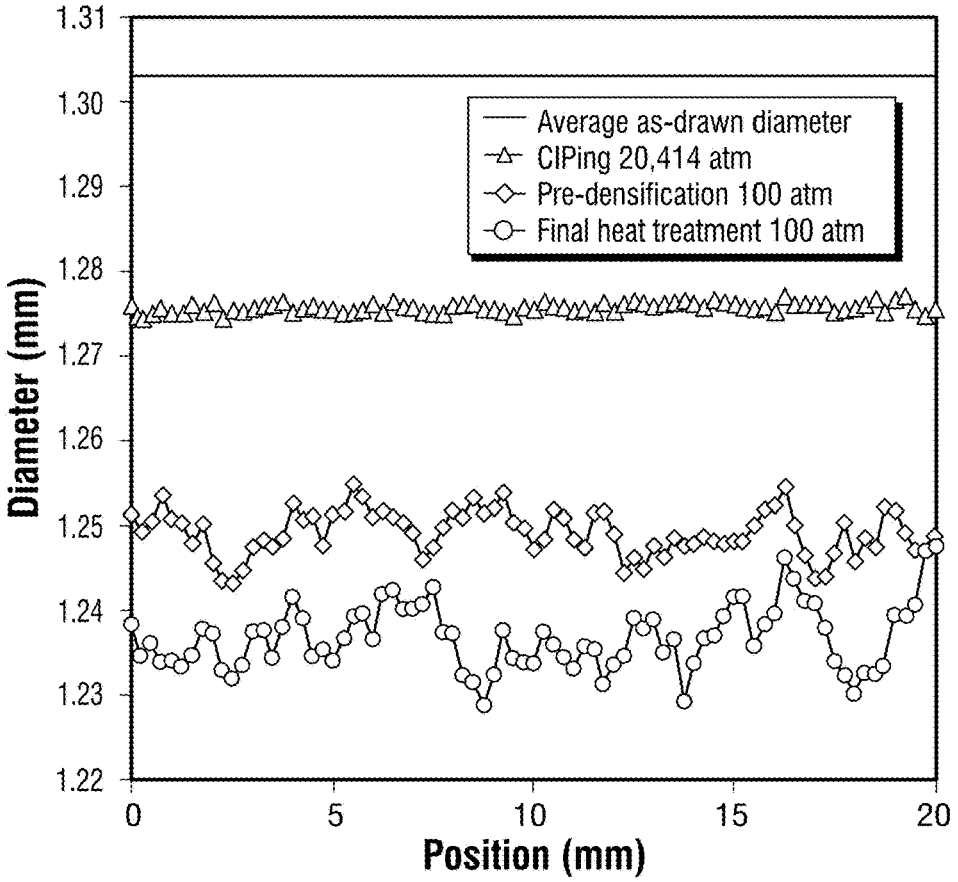
FIG. 3 depicts the change in diameter that occurs when one embodiment of a silver wire containing $Bi_2Sr_2CaCu_2O_{8+x}$ (Bi2212) powder is subjected to [1] cold isostatic pressing, and [2] one embodiment of the pre-densification process provided herein followed by a final heat treatment that melted the Bi2212 powder.

FIG. 3 depicts the change in diameter of one embodiment of a round silver wire containing Bi2212 powder that has been subjected to [1] cold isostatic pressing (CIP) at 20.4 katm; and [2] an embodiment of the pre-densification processes (at 100 atm) provided herein followed by a final heat treatment that melts the Bi2212 powder (at 100 atm). According to FIG. 3, the diameter of the wire decreased a total of about 5% as a result of the pre-densification and final heat treatment. However, the pre-densification process decreased the wire diameter by about 4%, so the final heat treatment, which typically generates high current density, further decreased the diameter by only about 1%. In other words, the pre-densification process employed in this embodiment accounted for about 80% of the total lessening of the diameter of the wire. Therefore, a coil formed from the pre-densified wire would endure no more than minor displacement of the wire during the final heat treatment, as compared to a coil made from as-drawn power-in-tube wire.

Super Conductor Precursor Powder

Generally, any superconductor precursor powder may be used that is capable of forming superconductor filaments upon cooling after a heat treatment that melts the superconductor precursor powder. A single superconductor precursor powder may be used, or combinations of two or more superconductor precursor powders may be used. As used herein, the phrase "superconductor precursor powder" refers to particles of one or more superconductor precursors having an average particle size of 1 mm or less. In embodiments, the one or more superconductor precursor powders have an average particle size of from about 10 μm to about 750 μm. In a particular embodiment, the particles are substantially spherical. In a further embodiment, the particles are substantially non-spherical. In an additional embodiment, the particles comprise substantially spherical and substantially non-spherical particles.

In embodiments, the superconductor precursor powder is a metal oxide. In one embodiment, the superconductor precursor powder is $Bi_2Sr_2CaCu_2O_{8+x}$ (Bi2212). The melting point of Bi2212 typically is about 884° C. The Bi2212 may be combined with other superconductor precursor powders, additives, or a combination thereof.

Metal Wires

The metal wires herein generally comprise one or more filament cavities in which a superconductor precursor powder is disposed. The ends of the metal wires may be sealed by any means known in the art, such as with the metal or metals of which the metal wire is made.

The metal wire may be formed with one or more conductive metals. Preferably, a ductile metal having high electrical conductivity. In one embodiment, the metal wire is a silver wire. In another embodiment, the metal wire is a silver alloy wire.

The metal wire may be of any desired length. For example, the metal wire may have a length of about 1 m to about 1 km. Longer lengths are envisioned. In embodiments, a metal wire subjected to one of the pre-densification processes provided herein may then be cut prior to arranging the wire into a particular configuration, such as a coil, and/or subjecting the wire to a heat treatment sufficient to melt the superconductor precursor powder.

The metal wires may have one filament cavity. Or, the metal wires may have two or more filament cavities. For example, the metal wires may include from 2 to 1,000 filament cavities. More than 1,000 filament cavities are possible. In one embodiment, the metal wires include 666 filament cavities, which may be obtained from wires have 18 filament cavities (37×18). The filament cavities generally are hollow spaces within a wire. The filament cavities may have a length that substantially corresponds to the length of a wire or a portion thereof. Such cavities preferably are substantially parallel to one another.

The metal wire, when viewed in cross-section, may be substantially circular. Other cross-sectional shapes are possible, however, such as non-circular, polygonal, elliptical, etc. One metal wire may have a single cross-sectional shape or a combination of different cross-sectional shapes. The metal wire also may include one or more tapered portions, perforations or other weakened portions, or combinations thereof. The filament cavities may terminate at the one or more tapered portions, perforations, or other weakened portions of the wire. Not wishing to be bound by any particular theory, it is believed that metal wires having a substantially circular cross-section are advantageous over tape-shaped structures, at least because of their ability to be twisted, electromagnetic isotropy, ability to be cabled easily, or combinations thereof.

In embodiments, the metal wire has a cross-sectional diameter of from about 0.5 mm to about 10 mm. In further embodiments, the metal wire has a cross-sectional diameter of from about 0.5 mm to about 5 mm. In additional embodiments, the metal wire has a cross-sectional diameter of from about 0.5 mm to about 3 mm. In a particular embodiment, the metal wire has a cross-sectional diameter of about 1.2 mm. The phrase "cross-sectional diameter," as used herein, refers to the largest dimension of the metal wire when viewed in cross-section; the term "diameter" is not intended to imply that the metal wire is substantially circular when viewed in cross-section.

Figure 4:
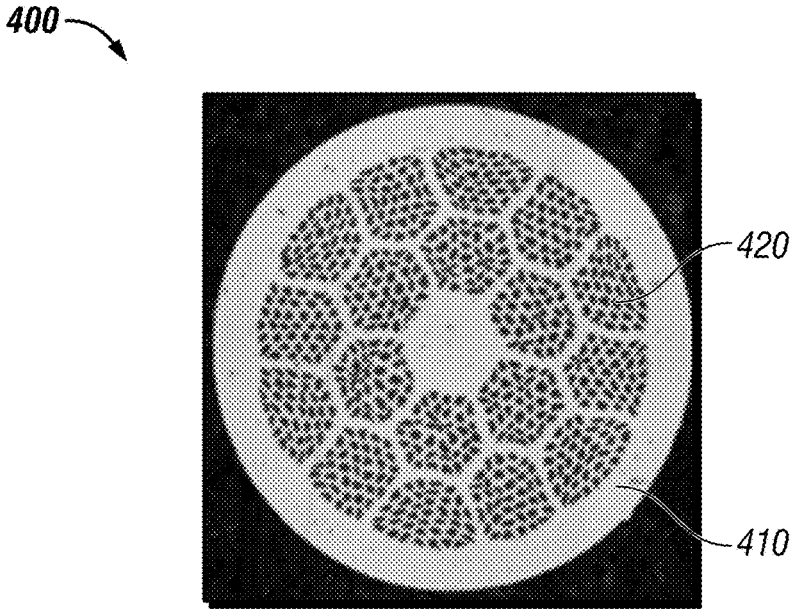
FIG. 4 depicts a cross-sectional view of one embodiment of an as-drawn metal wire containing a superconductor precursor powder that was made using PIT technology.

The metal wire may be made using well-known techniques in the art, such as powder-in-tube (PIT) technology, "rod and restack" methods, metal precursor methods, and processes that include folding powder into a metal sheath. One embodiment of such as tube is depicted in cross-section at FIG. 4. The cross-section of the metal wire 400 depicted at FIG. 4 includes a metal 410 and filament cavities 420 containing a superconductor precursor powder. In embodiments, a superconductor precursor powder is introduced into a metal sheath and drawn to a small-diameter, mono-filament cavity round wire. This wire may be sectioned and restacked in another metal sheath and drawn to a small-diameter, multi-filament cavity, single-stack round wire. For double-stack wires, the multi-filament cavity single stack round wire may be sectioned and restacked in a metal sheath, and drawn to a small-diameter, multi-filament cavity, double-stack round wire. This process can be extended to multi-stack round wires. A "round wire" is one that is substantially circular when viewed in cross-section. The metal sheaths may be formed of one or more conductive metals, including silver or silver alloy. Metal sheaths of different metals may be used to form a wire.

Figure 5A:
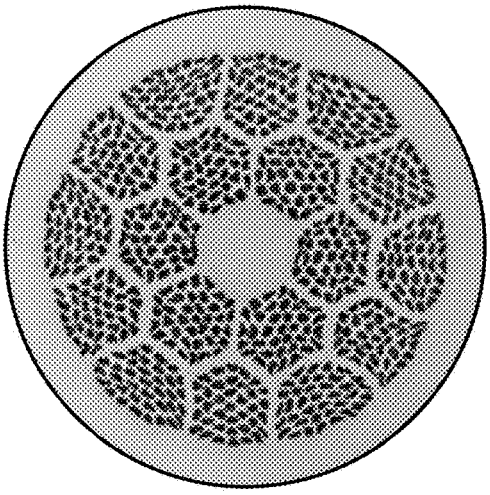
FIG. 5A depicts a scanning electron microscope micrograph in secondary electron mode of one embodiment of an as-drawn wire.
Figure 5B:
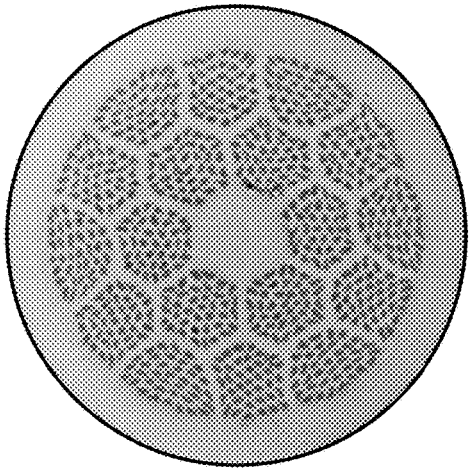
FIG. 5B depicts a scanning electron microscope micrograph in secondary electron mode of one embodiment of a wire after pre-densification at 100 atm and temperature of 800-870° C.

In as-drawn PIT wire, gas-filled voids usually are evenly distributed among the particles of a superconductor precursor powder in the filament cavities. In embodiments, the pre-densification processes provided herein can advantageously homogeneously densify the superconductor precursor powder without substantially altering the shape of the filament cavities. In one embodiment, the pre-densification processes provided herein do not substantially alter the cross-sectional shape of the metal wire, including those with substantially circular cross-sectional shapes. Cross-sectional views of an as-drawn wire and a pre-densified wire are depicted at FIG. 5A and FIG. 5B, respectively. The wires of FIG. 5A and FIG. 5B have a similar appearance, but due to the fact that the cross-sectional area of the pre-densified wire is smaller, the superconductor precursor powder in the pre-densified wire, FIG. 5B, is denser.

Metal wires that have been pre-densified according to the methods provided herein may be provided in place of as-drawn, un-predensified wire, thereby ensuring that the configurations of the pre-densified wire are not substantially altered during a heat treatment that melts the superconductor precursor powder.

Superconductor Materials

Superconductor materials are provided herein, including high temperature superconductor (HTS) materials. The superconductor materials may be in the shape of a wire, such as a coiled wire that has been pre-densified according to the processes provided herein, and subjected to a heat treatment that melts the one or more superconductor precursor powders in the wire.

Superconductor magnets also are provided. In embodiments, the superconductor magnets comprise a dense and stable winding pack made of dense, highly-textured oxide superconductor with relatively high critical current density.

The present invention is further illustrated by the following examples, which are not to be construed in any way as imposing limitations upon the scope thereof. On the contrary, it is to be clearly understood that resort may be had to various other aspects, embodiments, modifications, and equivalents thereof which, after reading the description herein, may suggest themselves to one of ordinary skill in the art without departing from the spirit of the present invention or the scope of the appended claims. Thus, other aspects of this invention will be apparent to those skilled in the art from consideration of the specification and practice of the invention disclosed herein.

EXAMPLES

Example 1

Pre-Densification of Silver Wire

A silver wire containing Bi2212 powder was pre-densified. The silver wire of this example was round when viewed in cross-section, and had a diameter of 1.2 mm. The silver wire of this example had one filament cavity, and the one filament cavity contained Bi2212 powder.

Silver wire sections that were 2 m long with both ends sealed with pure silver were wound on a 3 cm outside diameter ceramic barrel, and pre-densified at 820° C. for 2 h with a heating and cooling rate of 160° C./h at 50 atm total pressure. Different partial pressures of oxygen ($PO_2$) were used for each sample. One sample was pre-densified with a $PO_2$ of 0.2 atm, the second sample with $PO_2$ of 1 atm, and the third sample with $PO_2$ of 5 atm. The pressure and the $PO_2$ were set using a gas mixture of oxygen and argon with a specific vol. % of $O_2$. The powder was not melted during the pre-densification.

Then 8 cm samples of the pre-densified wires were cut from the 2 m samples. The short samples were sealed with pure silver and fully heat treated at about 890° C. and 50 atm OP with $PO_2$ of 1 atm. The powder was melted during the full heat treatment.

The diameter of the samples was measured before and after pre-densification with a laser micrometer in two orthogonal directions, and after heat treatment with an optical microscope, and the measurements were averaged.

Figure 6:
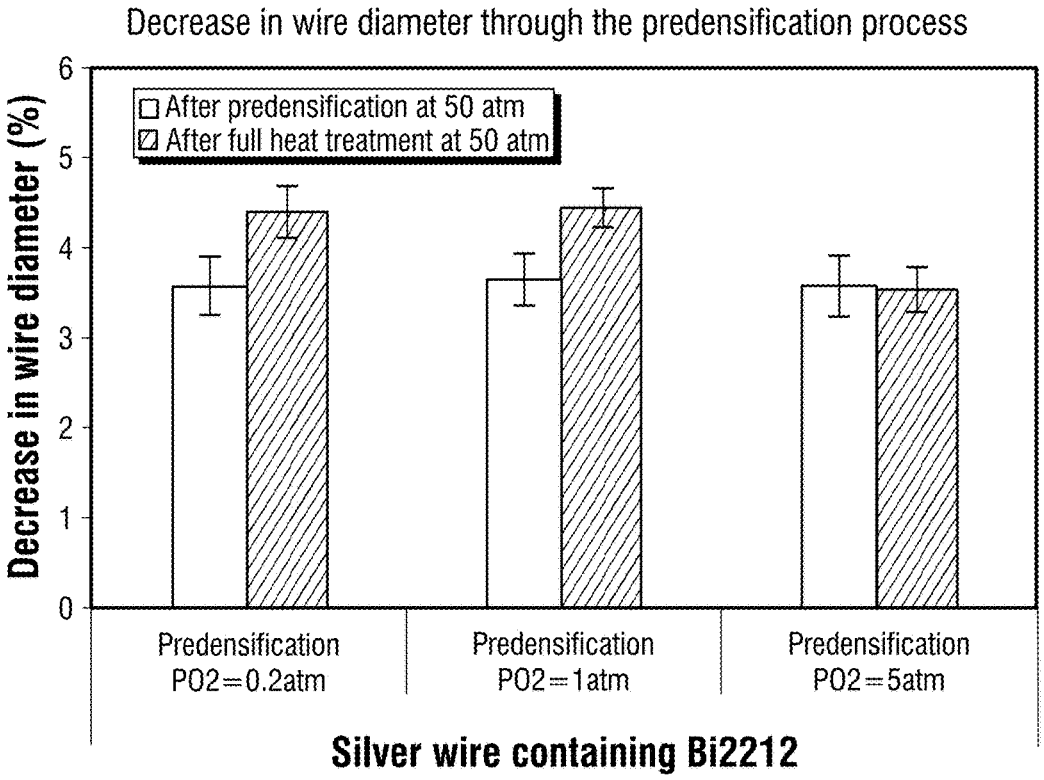
FIG. 6 depicts the decrease in wire diameter observed when different embodiments of a pre-densification process are performed followed by a final, full heat treatment that melts the Bi2212 powder.

FIG. 6 depicts the decrease in diameter of the samples after each heat treatment (pre-densification and full heat treatment) compared to the wire diameter of the as-drawn wire (no pre-densification or heat treatment).

It was observed that the pre-densification heat treatment resulted in similar decreases in wire diameter of 3.6±0.3%. After the full heat treatment, however, the samples pre-densified with $PO_2$ of 0.2 atm and 1 atm showed similar decreases in diameter of about 4.4±0.2%, but the sample pre-densified with $PO_2$ of 5 atm showed a decrease in wire diameter of about 3.5±0.5%. The fact that the sample pre-densified with $PO_2$ of 5 atm showed no further decrease in wire diameter during the full heat treatment appeared to suggest that the seal malfunctioned and the wire had open ends which did not allow further pre-densification.

This test demonstrated that the pre-densification treatment decreased the wire diameter by about 3.6% (which corresponded to 82% of the final decrease in wire diameter), which limited the decrease in wire diameter that occurred during the full heat treatment to only about 0.8% (which corresponded to 18% of the final decrease in wire diameter) compared to 4.4% decrease in wire diameter after full heat treatment. This considerably reduced the decrease in wire diameter that occurred during the full heat treatment from 4.4% with no pre-densification to 0.8% with pre-densification.

We claim:

1. A method of pre-densifying a metal wire containing superconductor materials, the method comprising:

providing a metal wire comprising one or more filament cavities in which a superconductor precursor powder is disposed;

subjecting the metal wire to a first temperature and a first pressure for a time sufficient to densify the superconductor precursor powder to form a pre-densified metal wire, wherein the first temperature is about 0.1% to about 50% less than the melting point of the superconductor precursor powder, the first pressure is sufficient, at the first temperature, to compress the metal wire to decrease a cross-sectional diameter of at least a portion of the metal wire, and the first pressure is applied by one or more gases; and subjecting the pre-densified metal wire to a second pressure and a second temperature, the second temperature being greater than the melting point of the superconductor precursor powder, for a time sufficient to melt the superconductor precursor powder, wherein, upon cooling, the melted superconductor precursor powder forms substantially continuous superconductor filaments.

2. The method of claim 1, wherein the metal wire is a conductive metal wire.

3. The method of claim 2, wherein the conductive metal wire is a silver wire or a silver alloy wire.

4. The method of claim 1, wherein the metal wire is uncoiled.

5. The method of claim 1, wherein the cross-sectional diameter is reduced by about 1% to about 6% by the first pressure.

6. The method of claim 1, wherein the cross-sectional diameter is reduced by about 1% to about 5% by the first pressure.

7. The method of claim 1, wherein the cross-sectional diameter is reduced by about 3% to about 4% by the first pressure.

8. The method of claim 1, wherein the first temperature is from about 750° C. to about 883° C.

9. The method of claim 1, wherein the first pressure is from about 50 atm to about 100 atm.

10. The method of claim 1, wherein at least a portion of the pre-densified metal wire has a cross-sectional diameter that is reduced by about 0.1% to about 2% by the second pressure.

11. The method of claim 1, wherein at least a portion of the pre-densified metal wire has a cross-sectional diameter that is reduced by about 0.3% to about 1.3% by the second pressure.

12. The method of claim 1, wherein at least a portion of the pre-densified metal wire has a cross-sectional diameter that is reduced by about 0.7% to about 1.2% by the second pressure.

13. The method of claim 1, further comprising coiling the pre-densified metal wire to form a coiled pre-densified metal wire prior to subjecting the pre-densified metal wire to the second pressure and the second temperature.

14. The method of claim 1, wherein the metal wire is substantially circular when viewed in cross-section.

15. The method of claim 1, wherein the metal wire is a multi-filament cavity, single-stack wire and the one or more filament cavities comprise from 2 to 1,000 filament cavities.

16. The method of claim 1, wherein the metal wire is a multi-filament cavity, double-stack wire and the one or more filament cavities comprise from 2 to 1,000 filament cavities.

17. The method of claim 1, wherein the superconductor precursor powder comprises $Bi_2Sr_2CaCu_2O_{8+x}$ (Bi2212).

18. A superconductor material comprising the pre-densified metal wire of claim 1.

19. The method of claim 1, wherein the one or more gases comprises a partial pressure of oxygen of from about 0.2 atm to about 5 atm.

* * * * *